US008167028B2

(12) United States Patent
Raver

(10) Patent No.: US 8,167,028 B2
(45) Date of Patent: May 1, 2012

(54) HEAT EXCHANGER FIN WITH PLANAR CRESTS AND TROUGHS HAVING SLITS

(75) Inventor: Jonathan Raver, Northville, MI (US)

(73) Assignee: Denso Corporation, Kariya (JP)

( * ) Notice: Subject to any disclaimer, the term of this patent is extended or adjusted under 35 U.S.C. 154(b) by 687 days.

(21) Appl. No.: 12/006,490

(22) Filed: Jan. 3, 2008

(65) Prior Publication Data

US 2009/0173477 A1 Jul. 9, 2009

(51) Int. Cl.

| | |
|---|---|
| ***F28D 1/02*** | (2006.01) |
| ***F28D 1/53*** | (2006.01) |
| ***F28F 1/32*** | (2006.01) |
| ***F28F 1/30*** | (2006.01) |

(52) U.S. Cl. ..... 165/152; 165/153

(58) Field of Classification Search ..... 165/104.26, 165/152, 153

See application file for complete search history.

(56) References Cited

U.S. PATENT DOCUMENTS

| | | | | |
|---|---|---|---|---|
| 4,469,168 | A * | 9/1984 | Itoh et al. | 165/152 |
| 4,615,384 | A * | 10/1986 | Shimada et al. | 165/152 |
| 5,078,207 | A * | 1/1992 | Asano et al. | 165/153 |
| 6,901,995 | B2 * | 6/2005 | Yamaguchi et al. | 165/152 |
| 6,907,919 | B2 * | 6/2005 | Zhang | 165/109.1 |
| 6,968,891 | B2 * | 11/2005 | Tochigi et al. | 165/152 |
| 2006/0131006 | A1 * | 6/2006 | Brost | 165/146 |

FOREIGN PATENT DOCUMENTS

JP 5-005597 1/1993

* cited by examiner

*Primary Examiner* — Cheryl J Tyler
*Assistant Examiner* — Brandon M Rosati
(74) *Attorney, Agent, or Firm* — Harness, Dickey & Pierce, PLC

(57) ABSTRACT

A heat exchanger has a pair of header tanks with a plurality of tubes and a plurality of fins extending between the pair of header tanks. Each fin forms a plurality of corrugations extending in a length direction between the pair of tanks. Each corrugation extends in a width direction and defines a plurality of sections which are offset from each other in the length direction of the fin. Each section is separated from an adjacent section by a slit.

17 Claims, 7 Drawing Sheets

HEAT EXCHANGER FIN WITH PLANAR CRESTS AND TROUGHS HAVING SLITS

FIELD

The present disclosure relates to heat exchangers having fins disposed between adjacent tubes. More particularly, the present disclosure relates to the fins which are disposed between adjacent tubes.

BACKGROUND

The statements in this section merely provide background information related to the present disclosure and may not constitute prior art.

Generally, a heat exchanger is installed in an automotive application in order to exchange heat between an internal fluid flowing through internal passages and an external fluid flowing through external passages. In a radiator heat is exchanged between an engine cooling fluid and air. In a heater core, heat is exchanged between an engine cooling fluid and air. In an evaporator, heat is exchanged between a refrigerant and air. In a condenser, heat is exchanged between a refrigerant and air.

A typical heat exchanger is a fin-tube type heat exchanger where the internal fluid flows through a plurality of tubes and the external fluid flows over the outside of the tubes. Fins are typically disposed between adjacent tubes in order to improve heat exchanger heat rejection by exposing multiple leading edge surfaces to the external fluid flow. The fins can include louvers which are formed with a twisting action of the central portion of the fin. This twisting action used to form the louvers limits the length of the louver to approximately 80% to 90% of the height of the fin. Heat exchanger performance is dependent on the effective length of the louver within the fin and thus it is advantageous to provide a louver with as large of a length as possible.

In addition, the twist forming of louvers causes a redirection of the external fluid as it passes over the louver. This redirection of the external fluid causes fluid pressure to drop which can decrease the total amount of the external fluid which passes through the heat exchanger thus adversely affecting its performance.

SUMMARY

The present disclosure includes a heat exchanger having a plurality of tubes having fins disposed between adjacent tubes. Each fin defines at least one louver and the length of each louver extends the entire length of the fin. In addition, each louver does not change the direction of the external fluid flowing over the louver. The fin and louver design of the present disclosure improves the performance of the heat exchanger by exposing multiple leading edge surfaces to the external fluid flow while significantly decreasing the pressure drop of the external fluid flow through the heat exchanger.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
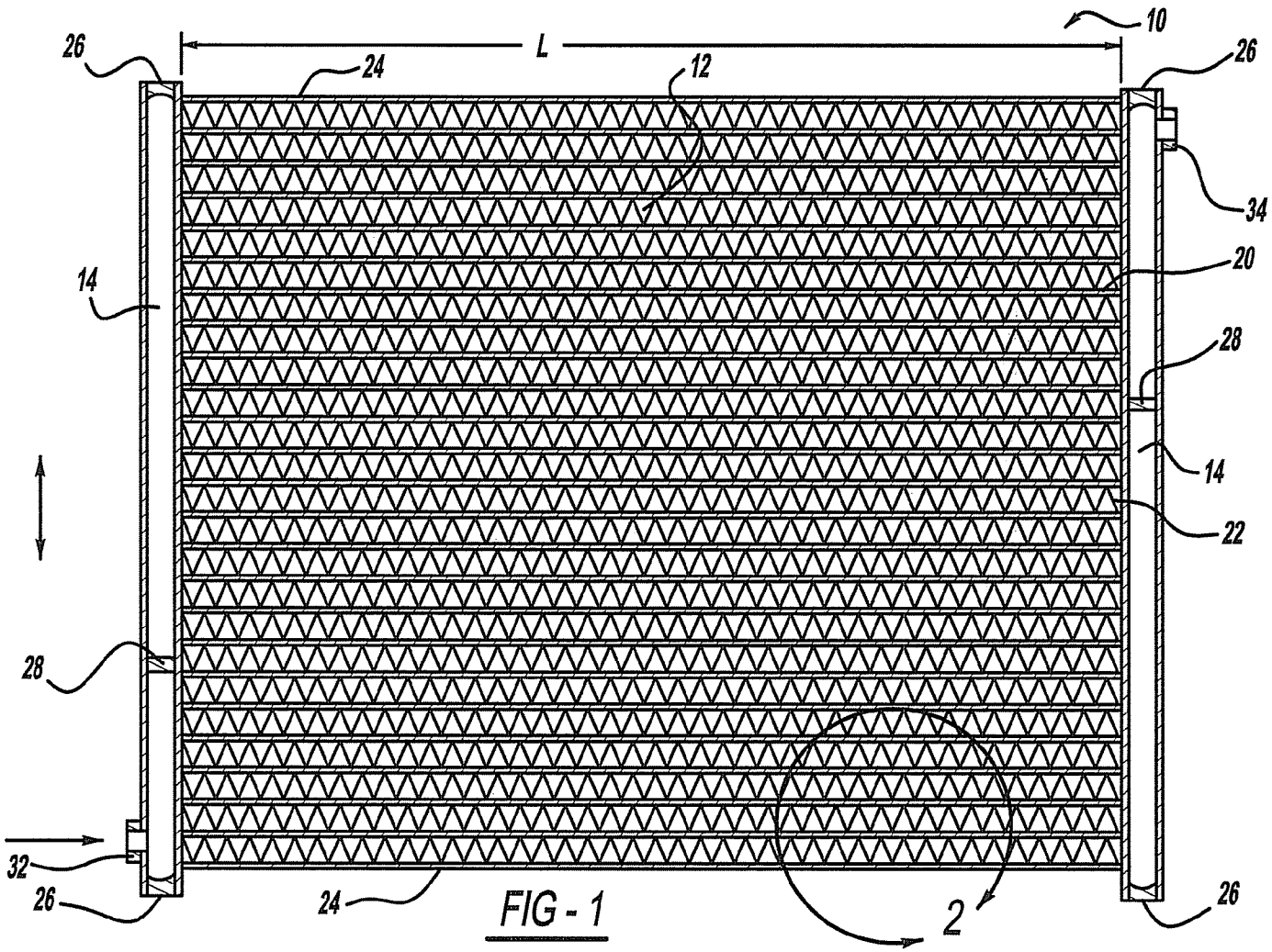
FIG. 1 is a front view illustrating an overall arrangement of a heat exchanger in accordance with the present disclosure.
Figure 2:
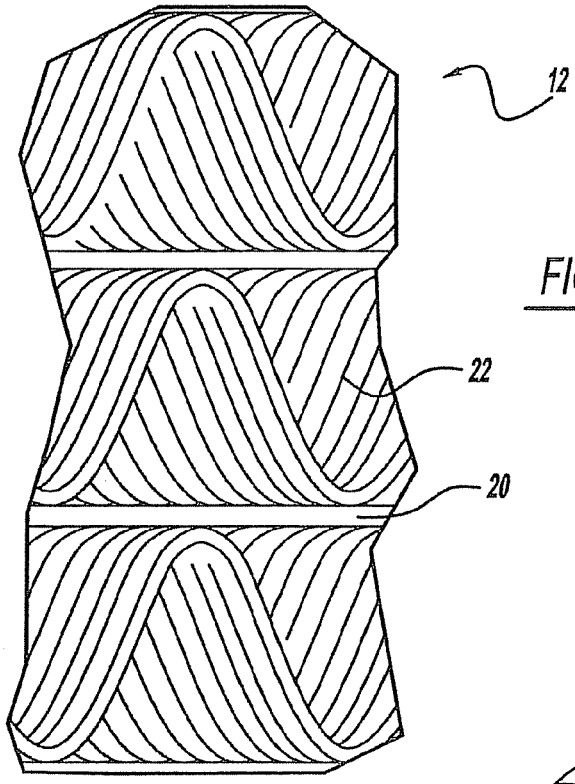
FIG. 2 is an enlarged view of the core portion of the heat exchanger illustrated in FIG. 1.

There is illustrated in FIG. 1 a heat exchanger incorporating the fins in accordance with the present disclosure and which is designated generally as reference numeral 10. Heat exchanger 10 comprises a core section 12 and a pair of header tanks 14 located at opposite ends of core section 12. As illustrated in FIG. 1, air flow through heat exchanger 10 is in a direction perpendicular to the plane of FIG. 1.

Core section 12 comprises a plurality of tubes 20 in which an internal fluid flows and a plurality of corrugated fins 22 which are formed into a wave shape. Each corrugated fin 22 is disposed between adjacent tubes 20 and are secured to tubes 20 by brazing or other methods known in the art. A pair of side plates 24 are located on opposite sides of the plurality of tubes and the plurality of fins to provide support and reinforcement for core section 12. Each side plate 24 is secured to a respective corrugated fin 22 by brazing or by other methods known in the art.

Each end of the plurality of tubes 20 is secured to a respective tank header tank 14 by brazing or by other means known in the art. The inside passage within each tube 20 is in communication with the inside chamber formed by header tanks 14. Each header tank 14 includes end caps 26 which close the inside chamber defined by header tank 14. As illustrated in FIG. 1, the left and right header tanks 14 each include a separator 28 which partitions the inside chamber formed by the left header tank 14.

An inlet joint 32 is secured to the lower side of left header tank 14 by brazing or any other known method in the art. An outlet joint 34 is secured to the upper side of left header tank 14 by brazing or by any other method known in the art. Internal fluid is introduced into heat exchanger 10 through inlet joint 32. The internal fluid flows through inlet joint 32, into the lower internal chamber of left header tank 14 through the lower plurality of tubes 20 and into the lower internal chamber of right header tank 14. From the lower right header tank 14, the internal fluid flows through the middle plurality of tubes 20 and into the upper internal chamber of left header tank 14. From the upper internal chamber of left header tank 14, the internal fluid flows through the upper plurality of tubes 20 into the upper internal chamber of right header tank 14 and out through outlet joint 34. While the internal fluid flows through heat exchanger 10 as described above, an external fluid flows between the plurality of tubes 20 and around the plurality of corrugated fins 22 to exchange heat between the internal fluid and the external fluid. In a radiator or heater core, the internal fluid is a coolant liquid and the external fluid is air. In an evaporator or a condenser, the internal fluid is a refrigerant and the external fluid is air.

While heat exchanger 10 has been illustrated as a triple section (upper, middle and lower) heat exchanger, it is within the scope of the present disclosure to have heat exchanger 10 designed as a single section heat exchanger or a multiple section heat exchanger where the fluid flows in multiple passes between header tanks 14.

Figure 4:
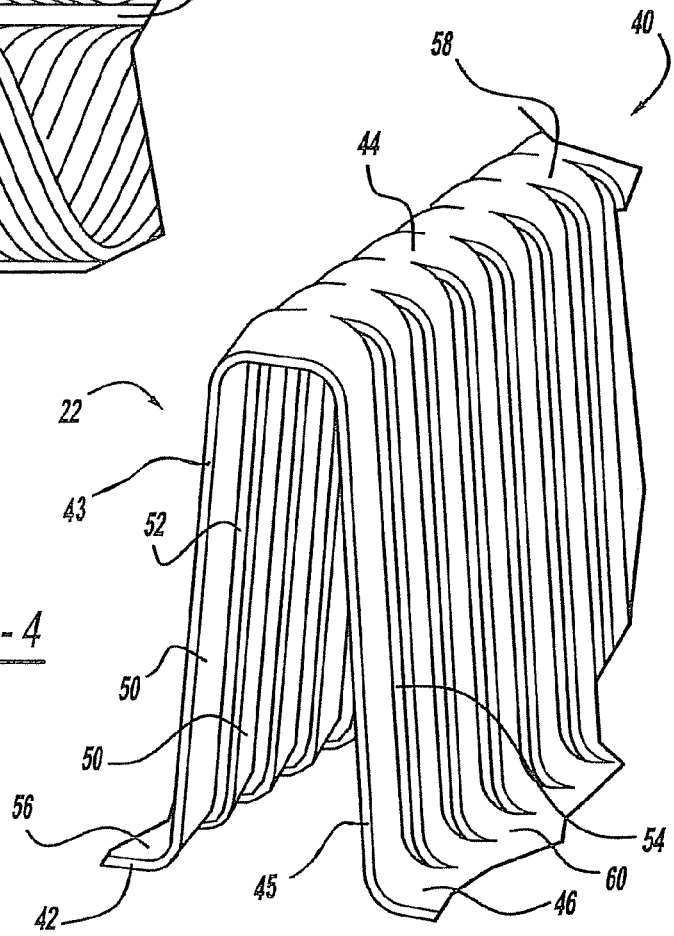
FIG. 4 is an enlarged perspective view of the corrugated fin illustrated in FIG. 3.
Figure 3:
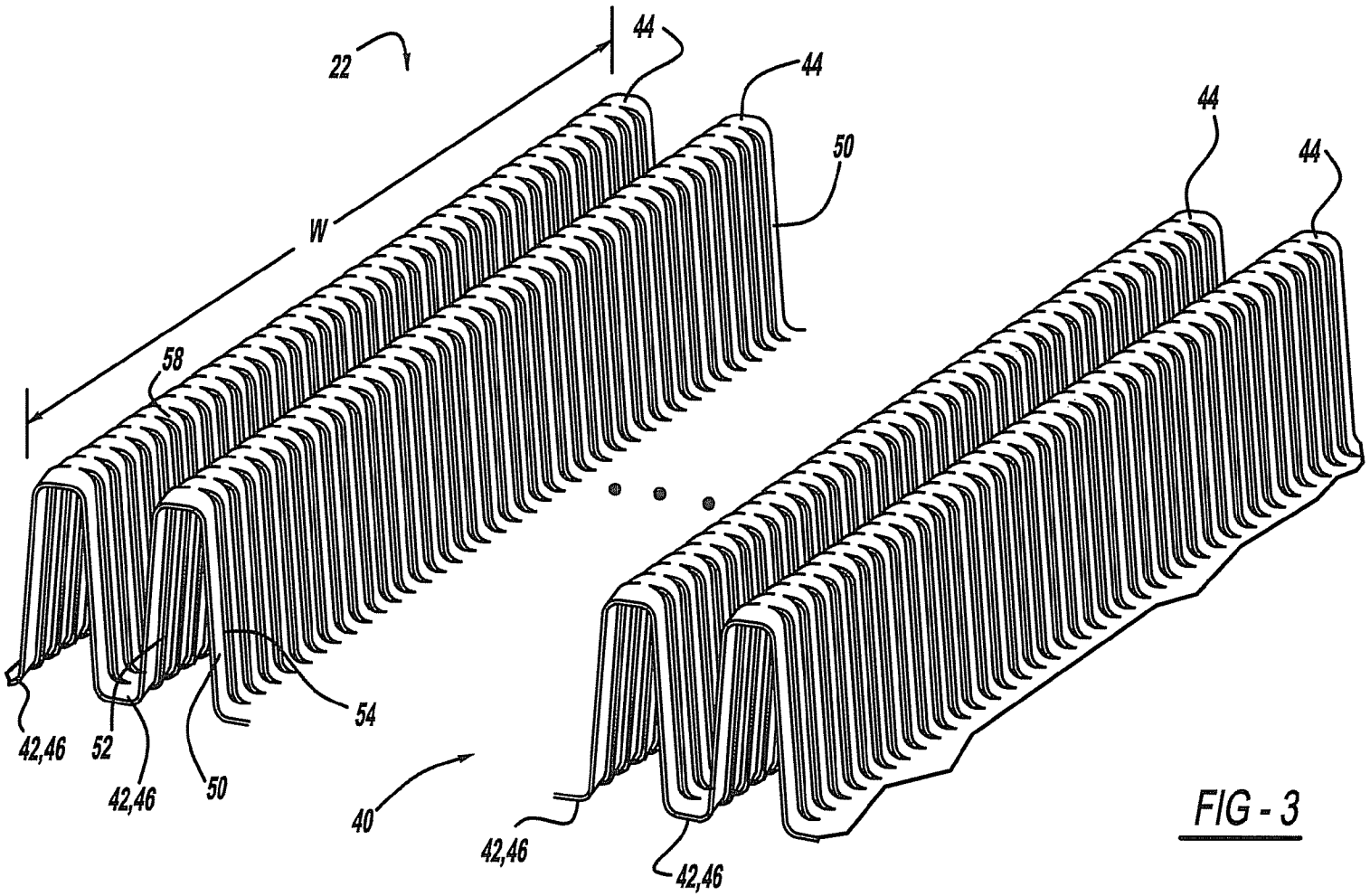
FIG. 3 is a perspective view of the corrugated fin illustrated in FIGS. 1 and 2.

Referring now to FIGS. 3 and 4, a corrugated fin 22 is illustrated in greater detail. Corrugated fin 22 includes a plurality of generally V-shaped corrugations 40 which extend over the length (L) of corrugated fin 22. Each V-shaped corrugation 40 includes a first planar trough 42, a first leg 43, a planar crest 44, a second leg 45, and a second planar trough 46. While corrugated fin 22 is illustrated as having a plurality of generally V-shaped corrugations 40, the present disclosure is not limited to V-shaped corrugations and any shape of corrugations including but not limited to U-shaped, S-shaped, rectangular shaped or other shapes for the corrugations can be used.

Each V-shape corrugation 40 extends over the width (W) of V-shaped corrugation 40 and defines a plurality of V-shaped sections 50. Each V-shaped section 50 is separated from an adjacent V-shaped section 50 by a first slit 52 that extends from first trough 42 to crest 44 and a second slit 54 that extends from second trough 46 to crest 44. Both first and second slits 52 and 54 extends through the material of corrugation 40 and into troughs 42 and 46 and crest 44 but do not extend across troughs 42 and 46 and crest 44. This creates a strip of material 56 at first trough 42, a strip of material 58 at crest 44 and a strip of material 60 at second trough 46 which interconnect the plurality of V-shaped sections 50. As illustrated in FIGS. 3 and 4, each V-shaped section 50 is offset in the length (L) direction of corrugated fin 22 by a specified dimension to create a louvered effect for corrugated fin 22. As illustrated in FIG. 3, the plurality of V-shaped sections 50 form a linear progression along the width (W) of corrugated fin 22. As described above, each V-shaped section 50 is offset in the length (L) direction of corrugated fin 22. This offset can be in the same direction for adjacent V-shaped sections 50, this offset can be in opposite directions for adjacent V-shaped sections 50; portions of V-shaped sections 50 can be offset in the same directions and other portions of V-shaped sections 50 can be offset in the opposite direction. Thus, the front half of V-shaped sections 50 can be in one direction and the back half of V-shaped sections 50 can be in the opposite direction. The plurality of V-shaped sections 50 can be divided into a plurality of groups having the same or different numbers of V-shaped sections in the group with adjacent groups being offset in opposite direction.

Figure 5:
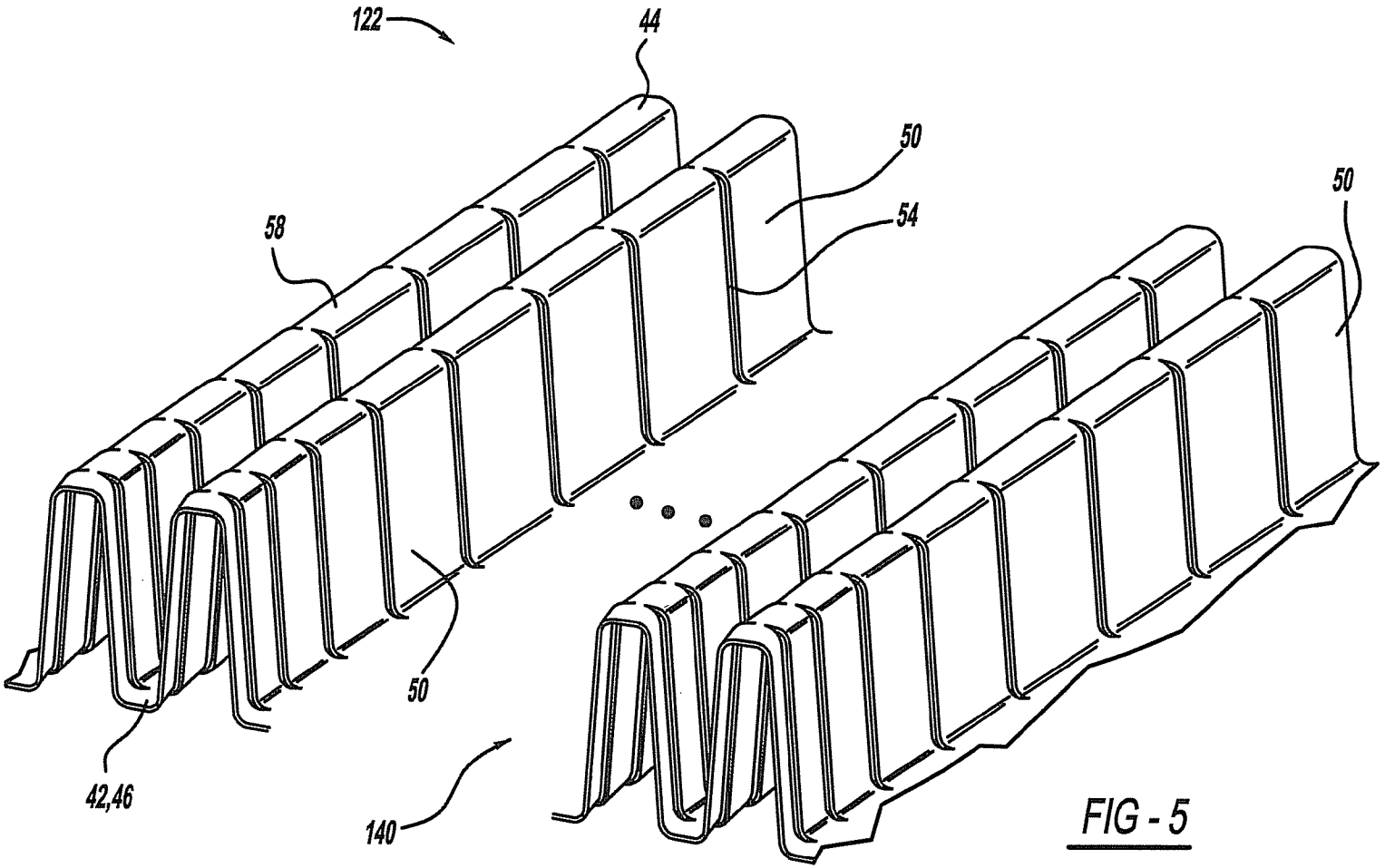
FIG. 5 is a perspective view of a corrugated fin in accordance with another embodiment of the present disclosure.

Also, as illustrated in FIGS. 3 and 4, the width of each V-shaped section 50 is the same. Referring to FIG. 5, a corrugated fin 122 having a plurality of V-shape corrugations 140 is illustrated which includes a plurality of V-shaped sections 50 where each V-shaped section 50 is a different width. While FIG. 5 illustrates each V-shaped section 50 as having a different width, the plurality of V-shaped sections 50 can be divided into a plurality of groups where each V-shaped section 50 in a single group has the same width but each group of V-shaped sections 50 have a different width.

Thus, the embodiment illustrated in FIG. 5 is the same as that discussed in relation to FIGS. 3 and 4 except for the width of the V-shaped sections 50 and thus the above discussion relating to V-shaped sections 50 for corrugated fin 22 apply to corrugated fin 122.

Figure 6A:
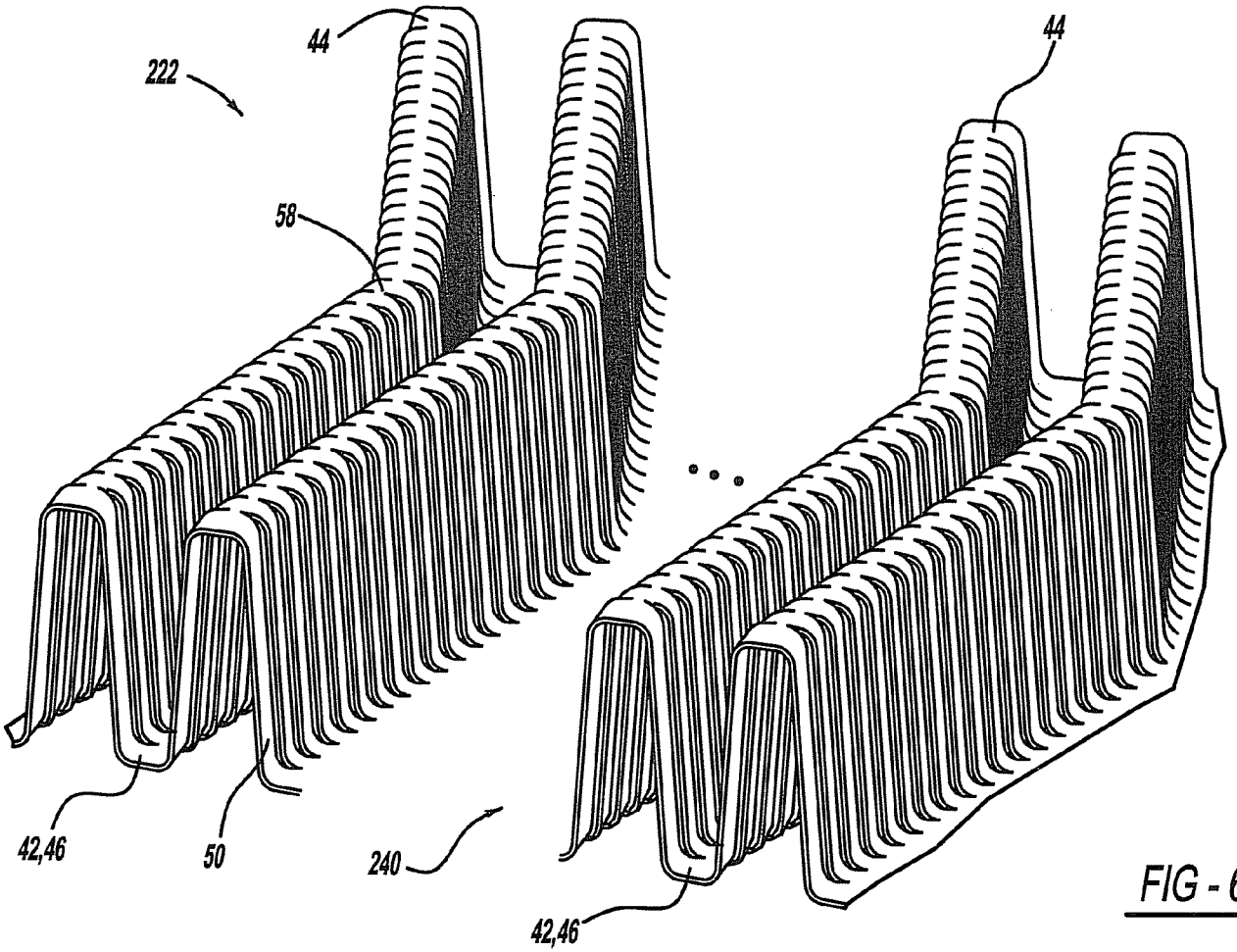
FIG. 6A is a perspective view of a corrugated fin in accordance with another embodiment of the present disclosure.

Referring now to FIG. 6A a corrugated fin 222 in accordance with another embodiment of the present disclosure is illustrated. Corrugated fin 222 includes a plurality of V-shape corrugations 240 that are formed in a bent or V-shape along the width of V-shaped corrugations 240. While the bent or V-shaped corrugations 240 are illustrated as having a plurality of V-shaped sections 50 having the same width, it is within the scope of the present disclosure to have different V-shaped sections 50 along the width of V-shape corrugations 240 as illustrated in FIG. 6B and as discussed above for FIG. 5.

Figure 6B:
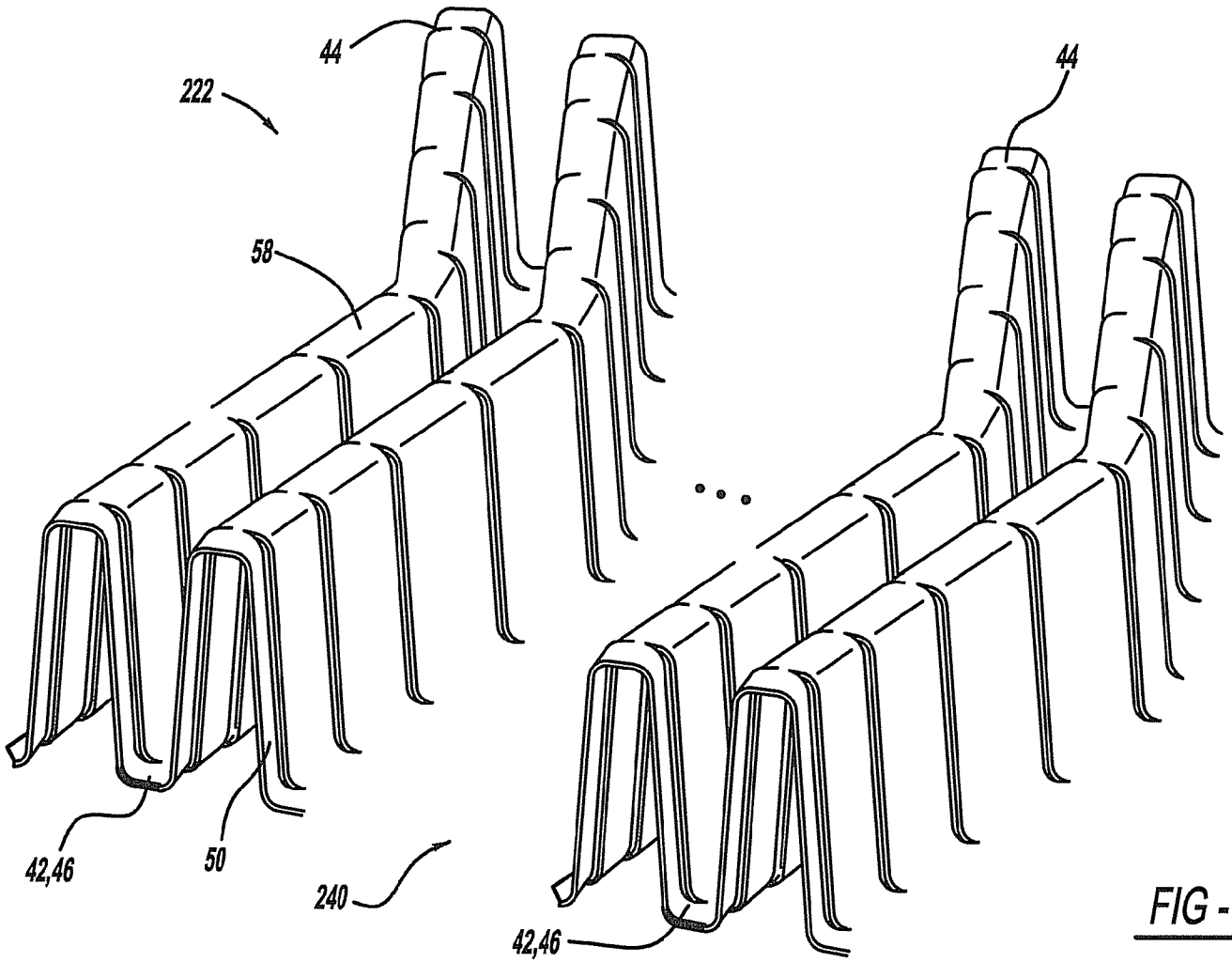
FIG. 6B is a perspective view of a corrugated fin in accordance with another embodiment of the present disclosure.

Thus the embodiment illustrated in FIGS. 6A and 6B are the same as discussed above in relation to FIGS. 3, 4 and 5 except for the bent or V-shaped width of V-shaped corrugations 240. Thus, the above discussion relating to V-shaped sections 50 for corrugated fin 22 and the above discussion relating to V-shaped sections 50 of fin 122 apply here also.

Figure 7:
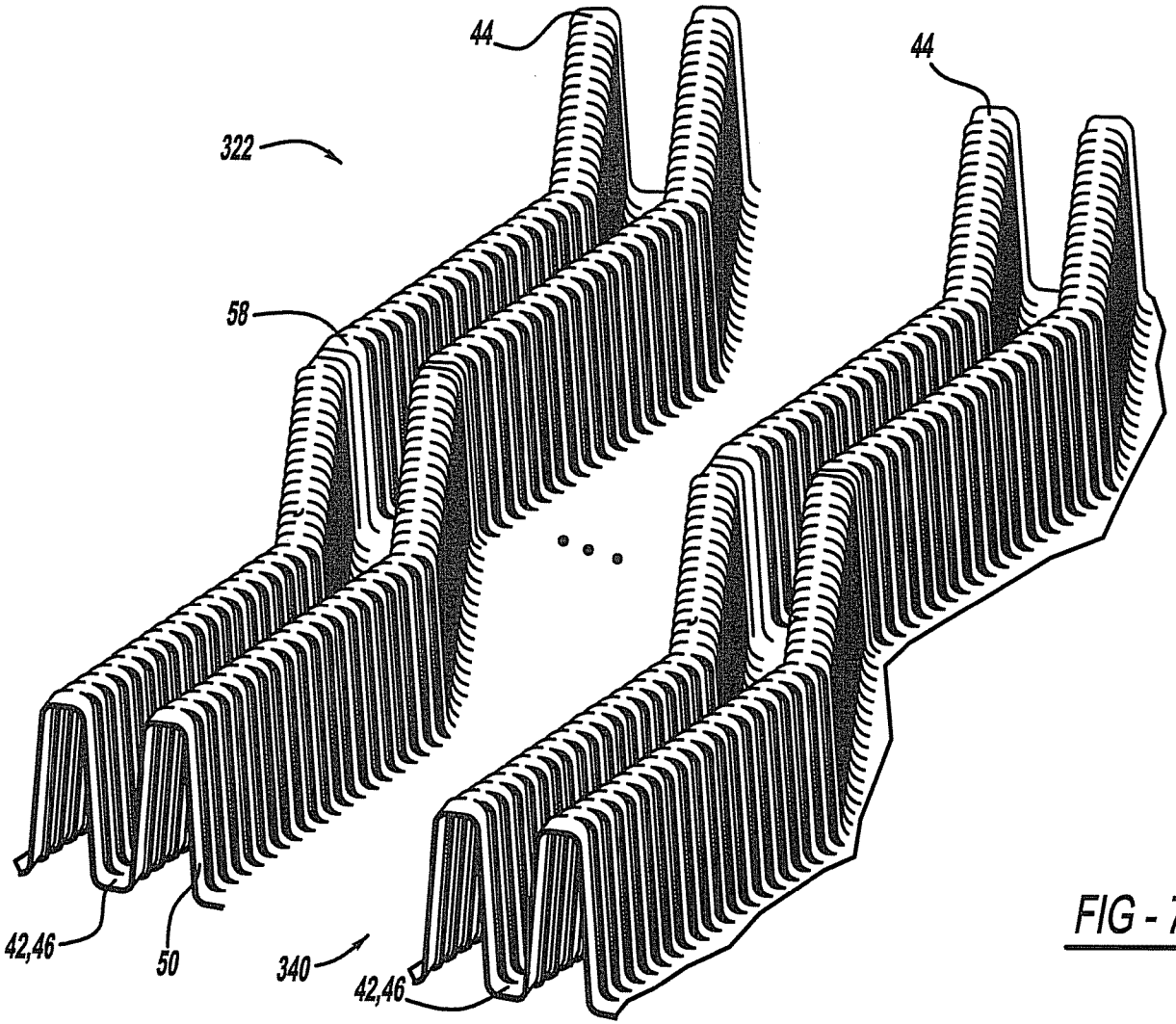
FIG. 7 is a perspective view of a corrugated fin in accordance with another embodiment of the present disclosure.

Referring now to FIG. 7, a corrugated fin 322 in accordance with another embodiment of the present disclosure is illustrated. Corrugated fin 322 includes a plurality of V-shaped corrugations 340 that are formed in a plurality of bends or V-shapes along the width of V-shaped corrugations 340. While the bent or V-shaped corrugations 240 are illustrated as having a plurality of V-shaped sections 50 having the same width, it is within the scope of the present disclosure to have different V-shaped sections 50 along the width of V-shaped corrugations 240 as discussed above for FIG. 5.

Thus the embodiment illustrated in FIG. 7 is the same as discussed above in relation to FIGS. 3, 4 and 5 except for the bent or V-shaped width of V-shaped corrugations 240. Thus, the above discussion relating to V-shaped sections 50 for corrugated fin 22 and the above discussion relating to V-shaped sections 50 of fin 122 apply here also.

What is claimed is:

1. A heat exchanger comprising:

a pair of header tanks;

a plurality of tubes extending between said pair of header tanks; and a plurality of fins extending in a length direction between said pair of header tanks; wherein each of said plurality of fins is defined by a strip of material formed into a plurality of U-shaped corrugations extending in said length direction, each U-shaped corrugation defining a first leg, a second leg and a planar crest extending between the first and second legs;

each first and second leg of each corrugation defining a width direction, each corrugation defines a plurality of sections extending in the width direction, each section being separated from an adjacent section in the length direction of the fin by a single slit through said strip of material configured to form a louver, said slit defining an upstream edge of one section and a downstream edge of an adjacent section, wherein no two sections of each corrugation are aligned in the same plane;

each of said single slits extending into a planar trough and the planar crest of said U-shaped corrugation but not through said planar trough or said planar crest; and each single slit in the first leg being aligned with a respective single slit in the second leg of each corrugation in the length direction to define a planar portion between the aligned single slits.

2. The heat exchanger according to claim 1, wherein each of said plurality of fins is disposed between adjacent tubes.

3. The heat exchanger according to claim 1, wherein each of said sections has an identical dimension in the width direction.

4. The heat exchanger according to claim 1, wherein one of said sections has a dimension in the width direction different than another of said sections.

5. The heat exchanger according to claim 1, wherein each of said sections has a different dimension in the width direction.

6. The heat exchanger according to claim 1, wherein each of said plurality of fins is disposed between adjacent tubes.

7. The heat exchanger according to claim 6, wherein each of said sections has an identical dimension in the width direction.

8. The heat exchanger according to claim 1, wherein each corrugation extends in a U-shape in the width direction.

9. The heat exchanger according to claim 8, wherein each of said plurality of fins is disposed between adjacent tubes.

10. The heat exchanger according to claim 8, wherein each of said sections has an identical dimension in the width direction.

11. The heat exchanger according to claim 8, wherein one of said sections has a dimension in the width direction different than another of said sections.

12. The heat exchanger according to claim 8, wherein each of said sections has a different dimension in the width direction.

13. The heat exchanger according to claim 1, wherein each corrugation forms a plurality of bends in the width direction.

14. The heat exchanger according to claim 13, wherein each of said plurality of fins is disposed between adjacent tubes.

15. The heat exchanger according to claim 13, wherein each of said sections has an identical dimension in the width direction.

16. The heat exchanger according to claim 13, wherein one of said sections has a dimension in the width direction different than another of said sections.

17. The heat exchanger according to claim 13, wherein each of said sections has a different dimension in the width direction.

* * * * *

UNITED STATES PATENT AND TRADEMARK OFFICE

CERTIFICATE OF CORRECTION

PATENT NO. : 8,167,028 B2
APPLICATION NO. : 12/006490
DATED : May 1, 2012
INVENTOR(S) : Jonathan Raver It is certified that error appears in the above-identified patent and that said Letters Patent is hereby corrected as shown below:

Title Page, Assignee should be:

--DENSO International America, Inc., Southfield, MI (US)--

Signed and Sealed this
Second Day of October, 2012

David J. Kappos

David J. Kappos
*Director of the United States Patent and Trademark Office*